US006320315B1

(12) United States Patent
Watkins

(10) Patent No.: US 6,320,315 B1
(45) Date of Patent: Nov. 20, 2001

(54) CERAMIC ELECTRON COLLECTOR ASSEMBLY HAVING METAL SLEEVE FOR HIGH TEMPERATURE OPERATION

(75) Inventor: Raymond F. Watkins, San Mateo, CA (US)

(73) Assignee: Litton Systems, Inc., Woodland Hills, CA (US)

( * ) Notice: Subject to any disclaimer, the term of this patent is extended or adjusted under 35 U.S.C. 154(b) by 0 days.

(21) Appl. No.: 09/176,629

(22) Filed: Oct. 22, 1998

(51) Int. Cl.[7] ..... H01J 23/027

(52) U.S. Cl. ..... 315/5.38; 313/45; 313/46; 445/35

(58) Field of Search ..... 315/5.38; 313/45, 313/46; 445/35

(56) References Cited

U.S. PATENT DOCUMENTS

| | | | | |
|---|---|---|---|---|
| 3,540,119 | | 11/1970 | Manoly | 29/600 |
| 3,586,100 | * | 6/1971 | Yasuda et al. | 313/40 X |
| 3,717,787 | * | 2/1973 | Doyle | 315/5.38 X |
| 3,823,772 | * | 7/1974 | Lavering et al. | 313/46 X |
| 3,930,182 | * | 12/1975 | Bretting | 315/5.38 X |
| 4,358,706 | | 11/1982 | Nazet et al. | 315/5.38 |

FOREIGN PATENT DOCUMENTS

| | | | | |
|---|---|---|---|---|
| 2449890 | * | 11/1975 | (DE) | 315/5.38 |
| 0 276 933 | | 8/1988 | (EP) . | |
| 0 924 740 | | 6/1999 | (EP) . | |
| 159933 | * | 6/1989 | (JP) | 315/5.38 |
| 117050 | * | 5/1990 | (JP) | 315/5.38 |

* cited by examiner

*Primary Examiner*—Benny T. Lee
(74) *Attorney, Agent, or Firm*—O'Melveny & Myers LLP

(57) ABSTRACT

A collector structure comprises a heat sink having a cylindrical opening, a sleeve disposed within the cylindrical opening of the heat sink, and a collector core disposed within the sleeve. The sleeve is comprised of a material having a rate of thermal expansion different than that of the heat sink and is disposed in close contact with the heat sink when the collector is at an elevated operational temperature. A slight gap is defined between the collector core and the sleeve when the collector is at an ambient temperature, and the collector core is in close contact with the sleeve when the collector is at the operational temperature. The heat sink further comprises either copper or aluminum, the sleeve is comprised of molybdenum, and the collector core is comprised of a ceramic material. To manufacture the collector structure, the heat sink is heated to a temperature above the operational temperature and the sleeve is inserted into the cylindrical opening of the heat sink at the elevated temperature. The collector core is then inserted into the sleeve at an ambient temperature of the collector structure. During operation of the collector, heat generated within the collector core is efficiently conducted through the sleeve to the heat sink.

20 Claims, 2 Drawing Sheets

CERAMIC ELECTRON COLLECTOR ASSEMBLY HAVING METAL SLEEVE FOR HIGH TEMPERATURE OPERATION

BACKGROUND OF THE INVENTION

1. Field of the Invention

The present invention is directed to collector assemblies used for collecting spent electrons in linear beam electron devices. More particularly, the invention is directed to a collector assembly having a hot-inserted molybdenum sleeve to separate the ceramic collector core from a corresponding heat sink in order to provide improved high temperature operation.

2. Description of Related Art

Linear beam electron devices are well known in the art for generating and amplifying high frequency signals. In a linear beam device, an electron gun comprising a cathode and an anode generates a linear beam of electrons. The electron beam passes through an interaction structure, or drift tube, in which the energy of the beam is transferred to an electromagnetic signal. At the end of the drift tube, the spent electrons of the beam pass into a collector structure that captures the electrons and recovers a portion of their remaining energy. Electrodes disposed within the collector structure are used to collect the spent electrons at close to their remaining energy level in order to return the electrons to the power source of the linear beam electron device. Energy of the spent electrons that cannot be collected onto the electrodes is dissipated into the collector structure in the form of heat.

Since linear beam electron devices operate at very high power levels, the collector structure must be capable of withstanding very high operating temperatures, e.g., above 200° Celsius. Moreover, the collector structure must stand off the voltage potential between individual ones of the collector electrodes. In view of these demanding operational requirements, the central core of the collector structure is often comprised of a thermally rugged and electrically non-conductive material, such as ceramic. To remove the heat from the collector core, collector assemblies generally also include a heat sink provided in contact with the outer surface of the collector core. Typically, the heat sink is made of a material having good thermal conductivity, such as copper or aluminum.

A drawback of such prior art collector assemblies is that the ceramic collector core and metal heat sink can be incompatible due to the differences in their respective rates of thermal expansion. In one method of manufacture known in the art, the ceramic collector is dimensioned to fit into a corresponding opening in the heat sink at room temperature. During high temperature operation, the metal heat sink expands at a higher rate than the ceramic core, causing the heat sink to expand away from the collector core and leave a gap between the two adjacent structures. The heat sink is thereby no longer effective in removing heat from within the ceramic collector core, resulting in excessive stress of the collector core and ultimately failure of the component. A proposed solution to this problem is to dimension the ceramic collector core to fit the thermally expanded size of the heat sink, and to insert the collector core into the heat sink with the heat sink pre-heated to the operational temperature. This method is not practical due to the difficulty of constructing the entire collector assembly in a high temperature environment.

It would therefore be highly desirable to provide a collector structure having a ceramic collector core that permits high temperature operation without the drawbacks of the prior art. More particularly, it would be desirable to provide a collector assembly having efficient heat transfer from the ceramic collector core to the surrounding heat sink while operating at relatively high temperatures.

SUMMARY OF THE INVENTION

In accordance with the teachings of the present invention, a collector structure for a linear beam device is provided which overcomes the drawbacks of the prior art. The collector structure comprises a heat sink having a cylindrical opening, a sleeve disposed within the cylindrical opening of the heat sink, and a collector core disposed within the sleeve.

In an embodiment of the invention, the sleeve is comprised of a material having a rate of thermal expansion different than that of the heat sink and is disposed in close contact with the heat sink when the collector is at an elevated operational temperature. A slight gap is defined between the collector core and the sleeve when the collector is at an ambient temperature, and the collector core is in close contact with the sleeve when the collector is at the operational temperature. The heat sink further comprises either copper or aluminum, the sleeve is comprised of molybdenum, and the collector core is comprised of a ceramic material. To manufacture the collector structure, the heat sink is heated to a temperature above the operational temperature and the sleeve is inserted into the cylindrical opening of the heat sink at the elevated temperature. The collector core is then inserted into the sleeve at an ambient temperature of the collector structure. During operation of the collector, heat generated within the collector core is efficiently conducted through the sleeve to the heat sink.

A more complete understanding of the collector structure and method for manufacturing same will be afforded to those skilled in the art, as well as a realization of additional advantages and objects thereof, by a consideration of the following detailed description of the preferred embodiment. Reference will be made to the appended sheets of drawings which will first be described briefly.

DETAILED DESCRIPTION OF THE PREFERRED EMBODIMENT

Figure 1:
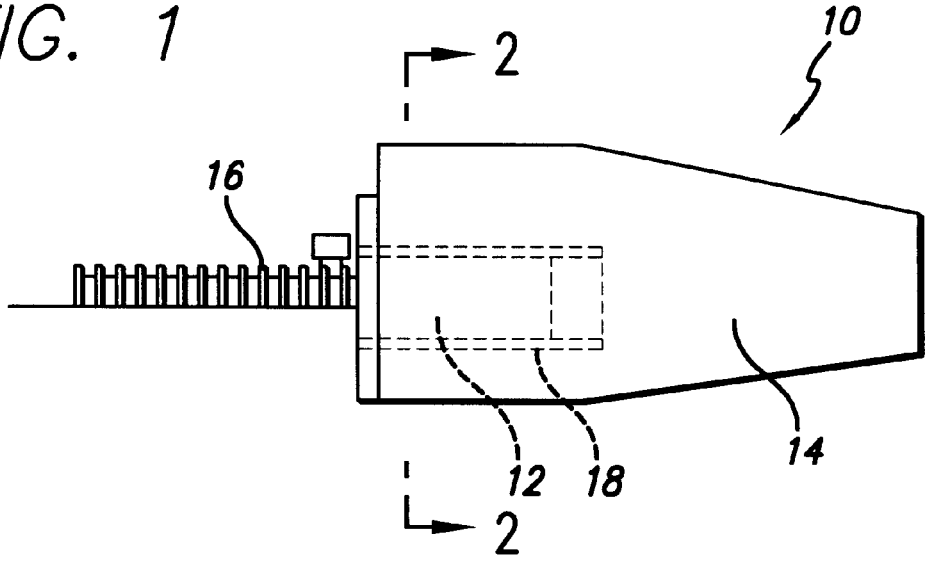
FIG. 1 is a sectional side view of an embodiment of a collector structure including the hot-inserted molybdenum sleeve.

The present invention satisfies the need for a collector structure having efficient heat transfer from the ceramic collector core to the surrounding metal heat sink while operating at relatively high temperatures. In the detailed description that follows, like reference numerals are used to describe like elements illustrated in one or more of the figures.

Figure 2:
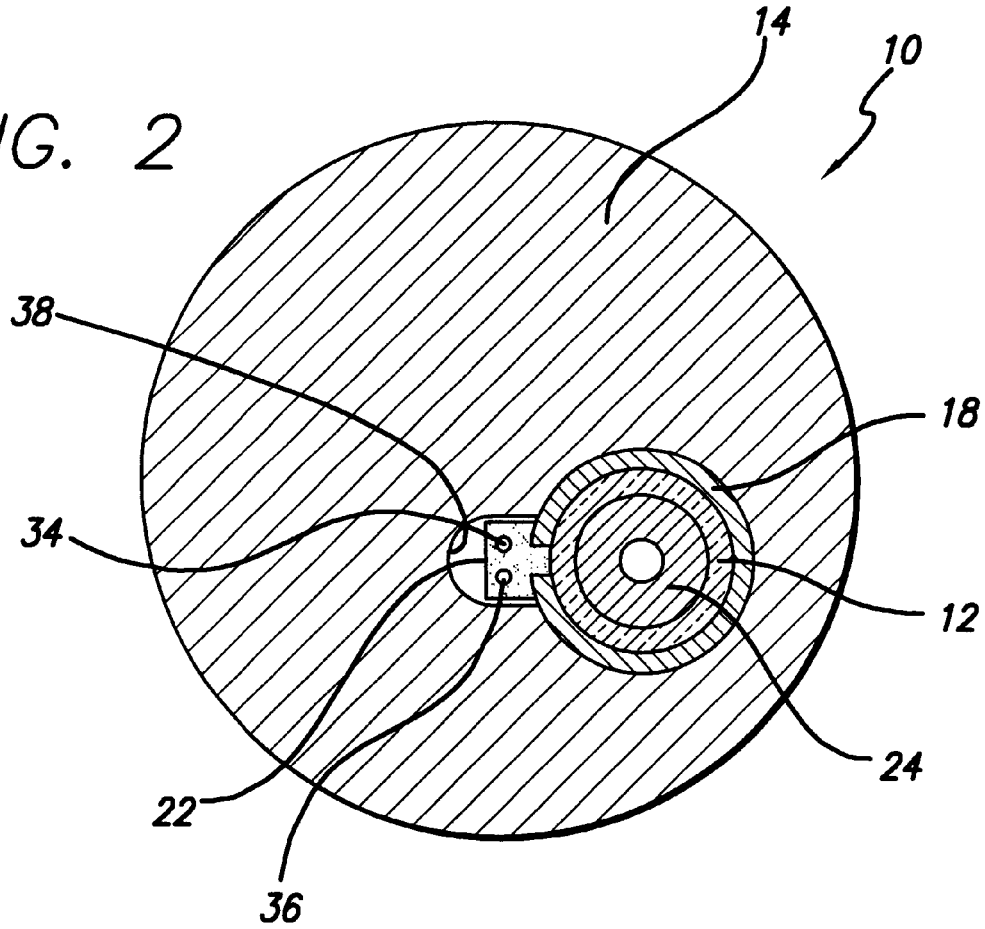
FIG. 2 is a sectional front view of the collector structure of FIG. 1.
Figure 3:
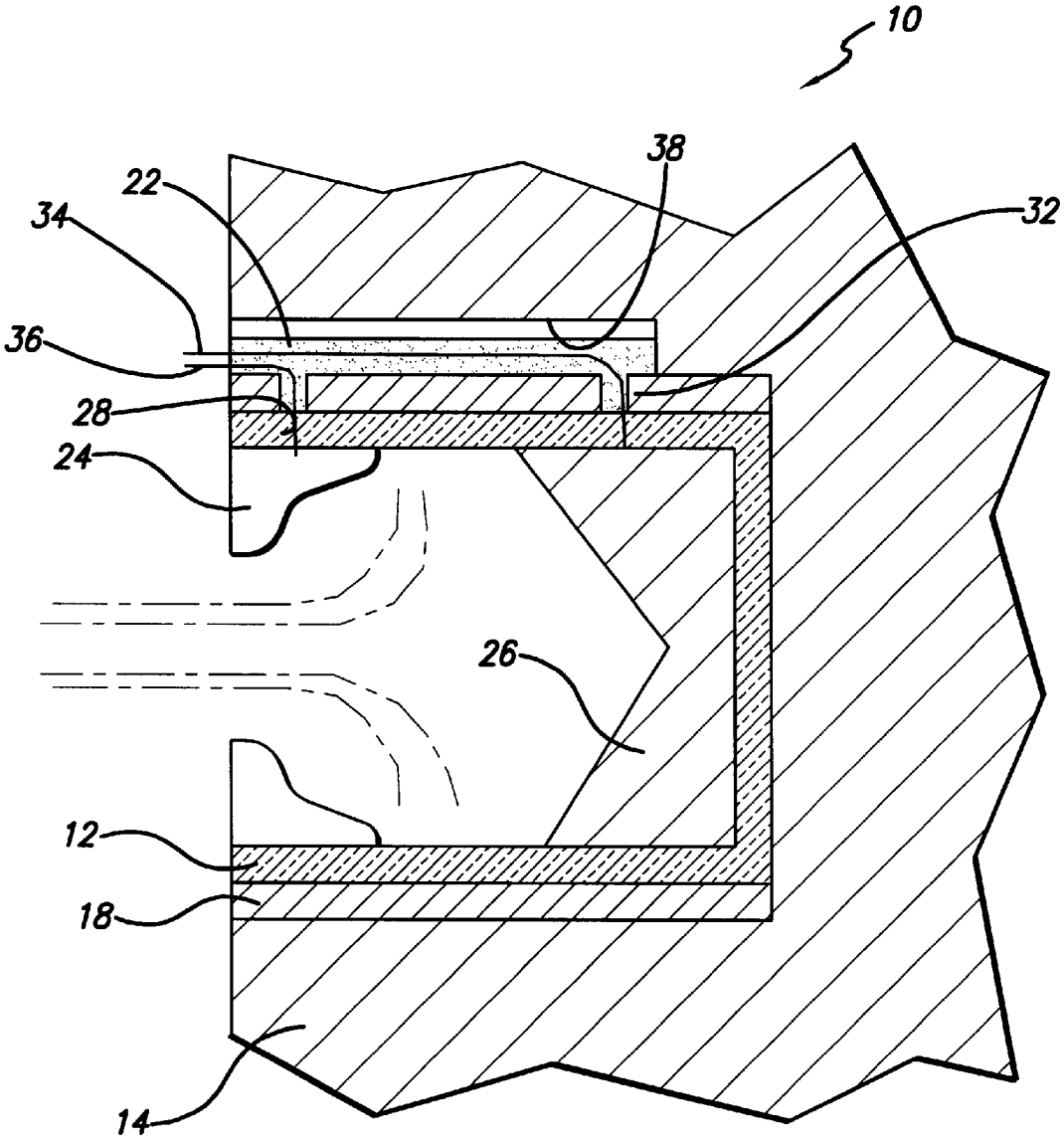
FIG. 3 is a sectional side view of the collector structure illustrating electrical connections to the collector electrodes.

Referring to FIGS. 1–3, an embodiment of a collector structure 10 for a linear beam device is illustrated. The linear beam device includes a drift tube 16 that encloses an axially extending electron beam (not shown). It should be appreciated that the linear beam device will also include other aspects, such as an electron gun, that are not pertinent to the present invention. The collector structure 10 includes a ceramic collector core 12, a heat sink 14, and a sleeve 18. The collector core 12 has a generally cylindrical shape with an opening aligned with the drift tube 16 to receive the spent electrons of the electron beam after passing through the linear beam device. As is known in the art, the collector core 12 is comprised of a ceramic material. The collector core 12 further includes one or more electrodes disposed therein (described below) to facilitate the efficient collection of the spent electrons. The linear beam device operates at a vacuum in which the drift tube 16 and the collector core 12 define the outer boundary of the vacuum envelope.

More particularly, the heat sink 14 has a frusto-conical shape with a diameter significantly larger than that of the collector core 12. The sleeve 18 is tubular in shape and completely encircles the collector core 12. The heat sink 14 has a cylindrical opening into which the collector core 12 and sleeve 18 is inserted. As will be further discussed below, the sleeve 18 is comprised of a material having a rate of thermal expansion lower than that of the collector core 12 and the heat sink 14, such as molybdenum. Additionally, collector core 12 is preferably comprised of a material having a rate of thermal expansion lower than that of heat sink 14. The heat sink 14 can comprise a material having good thermal conductivity, such as copper or aluminum, to allow efficient heat dissipation away from the collector core 12 and the sleeve 18. As will be understood from the following description, the sleeve 18 is disposed in close contact with the collector core 12 and the heat sink 14 to promote good thermal transfer from the collector core and the heat sink.

As shown in FIG. 3, the collector core 12 further includes electrodes 24 and 26. Electrode 24 is further illustrated in FIG. 2. Referring again to FIG. 3. Electrode 24 is disposed at the opening of the collector core 12, and provides an aperture through which the spent electrons pass. Electrode 26 is disposed at the back end of the collector 12. As known in the art, the electrodes 24, 26 may have different voltage potentials applied thereto to promote efficient collection of the electrons. An electrical lead 34 passes to the electrode 24 through a corresponding opening 28 provided through both the collector core 12 and the sleeve 18. Similarly, an electrical lead 36 passes to the electrode 26 through a corresponding opening 32 provided through both the collector core 12 and the sleeve 18. The heat sink 14 has a space 38 extending axially along the collector core 12 and sleeve 18 to permit the electrical leads 34, 36 to extend outwardly of the collector structure 10 to respective voltage sources. As shown in FIG. 2, the space 38 may be filled with a potting material 22 that insulates the electrical leads 34, 36 from each other and prevents movement of the electrical leads. The potting material 22 further serves as a seal to maintain the vacuum within the linear beam device. It should be appreciated that a greater or lesser number of electrodes may be provided in the collector core 12 as necessitated by the operating characteristics of the linear beam device.

The method of manufacturing the various elements of the collector structure 10 will now be described. The outside circumference of the sleeve 18 is machined to correspond with the thermally-expanded inside diameter of the tubular opening of the heat sink 14 when the heat sink is raised to a temperature of approximately 300° Celsius. This way, the sleeve 18 and the heat sink 14 will form a tight interference fit when the collector structure 10 is at an operational temperature. The inner circumference of the sleeve 18 is then bored to an inside diameter that is approximately 0.0002–0.0005 inches greater than the outside diameter of the collector core 12. Next, the heat sink 14 is heated to a higher temperature, such as approximately 350° Celsius, so that the heat sink expands slightly more. The sleeve 18 is inserted into the heat sink 14 at this higher temperature. After the sleeve 18 and heat sink 14 combination have cooled down to an ambient temperature, the sleeve and the heat sink are tightly contacting each other. The collector core 12 is inserted into the sleeve 18 at this lower temperature. Importantly, at this lower temperature, the collector core 12 fits loosely inside of the sleeve 18, permitting the collector core to be aligned properly within the sleeve merely by manual rotation of the collector core.

During operation, the collector structure 10 heats up as the spent electrons are collected. As a result of this warming, the various components of the collector assembly begin to expand; however, the thermal expansion rates of the components differ. Notably, the collector core 12 expands at a higher rate than the sleeve 18. Additionally, collector core 12 preferably expands at a lower rate than heat sink 14, creating a difference in thermal expansion between the heat sink and the collector core. Since the gap between the collector core 12 and the sleeve 18 is relatively small, there is good thermal conductivity between the collector core and the sleeve which improves as the collector core expands into the sleeve. In turn, there is good thermal conductivity between the sleeve 18 and the heat sink 14 since the components remain tightly pressed together. The sleeve 18 compensates for the higher expansion rate of the heat sink 14, and serves to maintain a thermal connection between collector core 12 and the heat sink. Since the heat is efficiently removed from the collector core 12, the device operates efficiently above the standard operating temperatures of 125° to 200° Celsius without risk of overheating or failing. Further, as discussed above, because the foregoing method permits the linear beam device and the collector core 12 to be assembled within the heat sink 14 and sleeve 18 at a lower temperature, the manufacture of the collector structure 10 is greatly simplified as compared to the prior art methods.

Having thus described a preferred embodiment of a collector structure for high temperature operation, it should be apparent to those skilled in the art that certain advantages of the within system have been achieved. It should also be appreciated that various modifications, adaptations, and alternative embodiments thereof may be made within the scope and spirit of the present invention. The invention is further defined by the following claims.

What is claimed is:

1. An apparatus for collecting electrons comprising:

a heat sink comprised of a first thermally conductive material and having a cylindrical opening;

a sleeve comprised of a second thermally conductive material having a rate of thermal expansion less than a rate of thermal expansion of said first material and being disposed within the cylindrical opening of the heat sink, said sleeve being in close contact with said heat sink when said apparatus is at an elevated operational temperature; and a collector core having an opening arranged so at to receive a beam of electrons therethrough and being disposed within the sleeve, a slight gap being defined between an outermost surface of said collector core and an innermost surface of said sleeve when said apparatus is at an ambient temperature, and said collector core being in close contact with said sleeve when said apparatus is at said elevated operational temperature.

2. The apparatus of claim 1, wherein the first thermally conductive material further comprises one of copper and aluminum.

3. The apparatus of claim 1, wherein the second thermally conductive material further comprises molybdenum.

4. The apparatus of claim 1, wherein the collector core is comprised of a ceramic material.

5. The apparatus of claim 1, further comprising at least one electrode disposed within said collector core.

6. The apparatus of claim 5, further comprising at least one electrical lead connected to said at least one electrode, said at least one electrical lead passing through at least one opening provided in said sleeve and said heat sink.

7. An apparatus for collecting electrons comprising:

a heat sink comprised of a first thermally conductive material and having a cylindrical opening;

a sleeve comprised of a second thermally conductive material having a rate of thermal expansion less than a rate of thermal expansion of said first material and being disposed within the cylindrical opening of the heat sink, said sleeve being in close contact with said heat sink when said apparatus is at an elevated operational temperature; and a collector core having an opening arranged so as to receive a beam of electrons therethrough and being disposed with the sleeve, a slight gap being defined between said collector core and said sleeve when said apparatus is at an ambient temperature, and said collector core being in close contact with said sleeve when said apparatus is at said elevated operational temperature, wherein the sleeve has an inside diameter at least 0.0002 inches larger than an outside diameter of said collector core.

8. An apparatus for collecting electrons comprising:

a heat sink comprised of a first thermally conductive material and having a cylindrical opening;

a sleeve comprised of a second thermally conductive material having a rate of thermal expansion less than a rate of thermal expansion of said first material and being disposed within the cylindrical opening of the heat sink, said sleeve being in close contact with said heat sink when said apparatus is at an elevated operational temperature; and a collector core having an opening arranged so as to receive a beam of electrons therethrough and being disposed with the sleeve, a slight gap being defined between said collector core and said sleeve when said apparatus is at an ambient temperature, and said collector core being in close contact with said sleeve when said apparatus is at said elevated operational temperature, wherein said collector core is comprised of a material having a rate of thermal expansion higher than that of said second thermally conductive material and lower than that of said first thermally conductive material.

9. A method of manufacturing a collector structure of use in collecting spent electrons from a linear beam device comprising the steps of:

heating a heat sink comprised of a first thermally conductive material and having a cylindrical opening to a temperature above an operational temperature of said collector structure;

inserting a sleeve comprised of a second thermally conductive material having a rate of thermal expansion different than a rate of thermal expansion of said first material into the cylindrical opening of the heat sink while said heat sink is at said temperature above an operational temperature, such that said sleeve is in close contact with said heat sink when said collector is at said operational temperature;

inserting a collector core into the sleeve at an ambient temperature, said collector core having an opening arranged so as to receive said spent electrons therein, a slight gap being defined between an outermost surface of said collector core and an innermost surface of said sleeve when said apparatus is at said ambient temperature, and said collector core being in close contact with said sleeve when said apparatus is at said operational temperature.

10. The method of manufacturing a collector structure as recited in claim 9, wherein said heating step further comprises selecting said first thermally conductive material from one of copper and aluminum.

11. The method of manufacturing a collector structure as recited in claim 9, wherein said first inserting step further comprises selecting molybdenum as said second thermally conductive material.

12. The method of manufacturing a collector structure as recited in claim 9, wherein said second inserting step further comprises selecting a ceramic material as said collector core.

13. A method of manufacturing a collector structure of use in collecting spent electrons from a linear beam device comprising the steps of:

heating a heat sink comprised of a first thermally conductive material and having a cylindrical opening to a temperature above an operational temperature of said collector structure;

inserting a sleeve comprised of a second thermally conductive material having a rate thermal expansion different than a rate of thermal expansion of said first material into the cylindrical opening of the heat sink such that said sleeve is in close contact with said heat sink when said collector is at an operational temperature;

inserting a collector core into the sleeve at an ambient temperature, said collector core having an opening arranged so as to receive said spent electrons therein, a slight gap being defined between said collector core and said sleeve when said apparatus is at said ambient temperature, and said collector core being in close contact with said sleeve when said apparatus is at said operational temperature, wherein the heating step further comprises heating the heat sink to approximately 350° Celsius.

14. An apparatus for collecting spent electrons from a linear beam device comprising:

a heat sink comprised of a first thermally conductive material and having a cylindrical opening;

a ceramic collector core disposed in said opening of said heat sink and having an opening arranged so as to receive a beam of electrons therethrough from said linear beam device; and means for compensating for a difference in thermal expansion rates between said heat sink and said collector core, wherein heat generated within said collector core is conducted to said heat sink through said compensating means, said compensating means being in close contact with said collector core when said apparatus is at an elevated operational temperature and a slight gap being defined between said compensating means and said collector core when said apparatus is at an ambient temperature.

15. The apparatus of claim 14, wherein said compensating means further comprises a sleeve comprised of a second thermally conductive material having a rate of thermal expansion less than a rate of thermal expansion of said first thermally conductive material and being disposed within the cylindrical opening of the heat sink between said collector core and said heat sink thereby compensating for said difference in thermal expansion therebetween.

16. The apparatus of claim 15, wherein the second thermally conductive material further comprises molybdenum.

17. The apparatus of claim 14, wherein the first thermally conductive material further comprises one of copper and aluminum.

18. The apparatus of claim 14, further comprising at least one electrode disposed within said collector core.

19. An apparatus for collecting spent electrons from a linear beam device comprising:

a heat sink comprised of a first thermally conductive material and having a cylindrical opening;

a ceramic collector core disposed in said opening of said heat sink and having an opening arranged so as to receive a beam of electrons therethrough from said linear beam device; and means for compensating for a difference in thermal expansion between said heat sink and said collector core, wherein said compensating means further comprises a sleeve comprised of a second thermally conductive material having a rate of thermal expansion less than a rate of thermal expansion of said first thermally conductive material and being disposed within the cylindrical opening of the heat sink between said collector core and said heat sink thereby compensating for said difference in thermal expansion therebetween, said sleeve being in close contact with said collector core when said apparatus is at an elevated operational temperature with a slight gap being defined between said collector core and said sleeve when said apparatus is at an ambient temperature, wherein the sleeve has an inside diameter at least 0.0002 inches larger than an outside diameter of said collector core.

20. An apparatus for collecting spent electrons from a linear beam device comprising:

a heat sink comprised of a first thermally conductive material and having a cylindrical opening;

a ceramic collector core disposed in said opening of said heat sink and having an opening arranged so as to receive a beam of electrons therethrough from said linear beam device; and means for compensating for a difference in thermal expansion between said heat sink and said collector core, wherein said compensating means further comprises a sleeve comprised of a second thermally conductive material having a rate of thermal expansion less than a rate of thermal expansion of said first thermally conductive material and being disposed within the cylindrical opening of the heat sink between said collector core and said heat sink thereby compensating for said difference in thermal expansion therebetween, said sleeve being in close contact with said collector core when said apparatus is at an elevated operational temperature with a slight gap being defined between said collector core and said sleeve when said apparatus is at an ambient temperature, wherein said ceramic collector core has a rate of thermal expansion higher than that of said second thermally conductive material and lower than that of said first thermally conductive material.

* * * * *